US006817444B1

(12) United States Patent
Shinas

(10) Patent No.: US 6,817,444 B1
(45) Date of Patent: Nov. 16, 2004

(54) SUSPENDED WORK PLATFORM

(76) Inventor: George Shinas, 30 South St., Mount Vernon, NY (US) 10550

( * ) Notice: Subject to any disclaimer, the term of this patent is extended or adjusted under 35 U.S.C. 154(b) by 0 days.

(21) Appl. No.: 10/241,170

(22) Filed: Sep. 10, 2002

(51) Int. Cl.[7] ..... E04G 3/10; E01D 19/08
(52) U.S. Cl. ..... 182/150; 14/74
(58) Field of Search ..... 14/74, 22, 23, 14/18; 182/150, 222, 223, 138

(56) References Cited

U.S. PATENT DOCUMENTS

| | | | |
|---|---|---|---|
| 629,935 | A | 8/1899 | Sturgis |
| 2,043,128 | A | 6/1936 | Sutton |
| 2,057,092 | A | 10/1936 | Geib |
| 2,524,302 | A | 10/1950 | Benson |
| 3,076,522 | A | 2/1963 | Goodell |
| 3,945,462 | A | 3/1976 | Griswold |
| 4,276,959 | A | 7/1981 | Barber |
| 4,811,530 | A | 3/1989 | Eyerly |
| 4,854,419 | A | 8/1989 | Lyras et al. |
| 5,011,710 | A | 4/1991 | Harrison |
| 5,299,655 | A | 4/1994 | Margartis |
| 5,678,654 | A | 10/1997 | Uzawa |
| 5,730,248 | A | 3/1998 | Apostolopoulos |
| 5,911,288 | A | 6/1999 | Zafirakis |
| 5,921,346 | A | 7/1999 | Apostolopoulos |
| 6,003,634 | A | 12/1999 | Apostolopoulos |
| 6,135,240 | A | 10/2000 | Apostolopoulos |
| 6,138,793 | A | 10/2000 | Apostolopoulos |
| 6,227,331 | B1 | 5/2001 | Apostolopoulos |
| 6,264,002 | B1 | 7/2001 | Apostolopoulos |
| 6,302,237 | B1 | 10/2001 | Apostolopoulos |

*Primary Examiner*—Hugh B. Thompson, II
(74) *Attorney, Agent, or Firm*—Michael I. Kroll

(57) ABSTRACT

A cable suspended hermetic structure having a floor and walls combining with the undersurface of superstructure substructure such as a bridge forming an enclosure defining a workspace wherein one or more persons having access to the bridge substructure can work to repair and maintain said structure while containing the debris derived from said work within the enclosed structure and where applicable an external source of filtering air can be connected to the interior of the enclosure without comprising the hermetic nature of the enclosure.

7 Claims, 12 Drawing Sheets

SUSPENDED WORK PLATFORM

BACKGROUND OF THE INVENTION

1. Field of the Invention

The present invention relates generally to bridges and, more specifically, to temporary suspended work platforms comprising a floor and walls combining with the undersurface of a suspended bridge or roadway to form enclosure defining a workspace wherein one or more persons having access to the bridge or roadway superstructure can descend for repair and maintenance of the underside of said bridge or roadway.

The temporary suspended work platform has a floor consisting of a plurality of overlapping corrugated steel sheets substantially coplanar with the roadway. The corrugated steel sheets have a support structure thereunder comprising longitudinally positioned cables extending from the abutment members and perpendicular support members whereby said interlocking cables support the corrugated steel work platform, work crew, spent steel abrasives and relevant equipment and act as a dampening element against wind sheer caused by sealing the work platform to the bridge by means of flexible sheet material.

The flexible walls are releasably fastened to the periphery of the work platform and extend substantially vertical to the roadway where it is releasably attached by fasteners to the roadway by ties to the guiderails and may additionally be anchored between said guiderails by placing weights on the material extending between the guiderails.

Additionally the containment platform can be segmented by erecting partitions which seal one segmented section from the other.

2. Description of the Prior Art

There are other work platforms device designed for suspension. Typical of these is U.S. Pat. No. 629,935 issued to Sturgis on Aug. 1, 1899.

Another patent was issued to Sutton on Jun. 2, 1936 as U.S. Pat. No. 2,043,128. Yet another U.S. Pat. No. 2,057,092 was issued to Geib on Oct. 13, 1936 and still yet another was issued on Oct. 3, 1950 to Benson as U.S. Pat. No. 2,524,302.

Another patent was issued to Goodell on Feb. 5, 1963 as U.S. Pat. No. 3,076,522. Yet another U.S. Pat. No. 3,945,462 was issued to Griswold on Mar. 23, 1976. Another was issued to Barber on Jul. 7, 1981 as U.S. Pat. No. 4,276,959 and still yet another was issued on Mar. 14, 1989 to Eyerly as U.S. Pat. No. 4,811,530.

Another patent was issued to Lyras et al. on Aug. 8, 1989 as U.S. Pat. No. 4,845,419. Yet another U.S. Pat. No. 5,011,710 was issued to Harrison on Apr. 30, 1991. Another was issued to Margaritis on Apr. 5, 1994 as U.S. Pat. No. 5,299,655 and still yet another was issued on Oct. 21, 1997 to Uzawa as U.S. Pat. No. 5,678,654.

Another patent was issued to Apostolopoulos on Mar. 24, 1998 as U.S. Pat. No. 5,730,248. Yet another U.S. Pat. No. 5,911,288 was issued to Zafirakis on Jun. 15, 1999. Another was issued to Apostolopoulos on Jul. 13, 1999 as U.S. Pat. No. 5,921,346 and still yet another was issued on Dec. 21, 1999 to Apostolopoulos as U.S. Pat. No. 6,003,634.

Another patent was issued to Apostolopoulos on Oct. 24, 2000 as U.S. Pat. No. 6,135,240. Yet another U.S. Pat. No. 6,138,793 was issued to Apostolopoulos on Oct. 31, 2000. Another was issued to Apostolopoulos on May 8, 2001 as U.S. Pat. No. 6,227,331. Another was issued on Jul. 24, 2001 to Apostolopoulos as U.S. Pat. No. 6,242,002 and still yet another was issued on Oct. 16, 2001 to Apostolopoulos as U.S. Pat. No. 6,302,237.

U.S. Pat. No. 629,935

Inventor: Nelson H. Sturgis

Issued: Aug. 1, 1899

The invention in a suspension bridge is the combination with columns, and anchored main cables, of hanger rods fast with the main cables and carrying the needle-beams, anchored joist cables laid on the needle-beams, side cables joined to the hanger-rods and fitted below the ends of the needle-beams, horizontal truss cables fitted around the ends of the needle-beams, and a floor laid on the joist-cables, substantially as described.

U.S. Pat. No. 2,043,128

Inventor: Cyril D. Sutton

Issued: Jun. 2, 1936

The invention is a scaffold including a platform having a permanent deck formed with a substantially centrally located opening which is adapted to accommodate a vertical structural member when the scaffold is arranged in position and being formed with a passage which leads from the margin of said platform to said opening, whereby said platform may be moved laterally to position said member in said opening, a floor section carried by said platform which is movable to cover the greater part of said passage when said member occupies said opening, an auxiliary floor section which is movable to cover the remainder of said passage, said auxiliary section being available to increase the size of said opening when necessitated by the use of the platform in connection with a larger structural member and means for supporting said platform at a determined height with respect to said first mentioned member.

U.S. Pat. No. 2,057,092

Inventor: Robert Lewis Geib

Issued: Oct. 13, 1936

The invention discloses means for supporting one platform at right angles to another platform comprising a bracket, said bracket comprising a pair of parallel T shaped flanges connected by a tierod, one side of the vertical portions of said T comprising means for supporting a platform, the horizontal branches of said T which extend on the other side of the vertical portions thereof comprising means for supporting said bracket by the side of the supporting platform.

U.S. Pat. No. 2,525,302

Inventor: Jesse Mack Benson

Issued: Oct. 3, 1950

The invention is a scaffold supporting bracket comprising a pair of elongated oppositely disposed parallel extending angle members on which planks may be supported, means securing said angle members together in spaced apart relation longitudinally thereof, a first supporting rod having a loop formed on one end loosely extending between said angle members at one end of the latter, pivot means carried by said angle members extending through said loop for rockably connecting said rod to said angle members, a second supporting rod having a loop formed on one end extending loosely between said angle members at the other end thereof, pivot means extending through the loop of said second supporting rod for rockably connecting said second rod to said angle members, and bent tabs formed on the opposite ends of said angle members closing the space between the latter and engageable with the adjacent ones of said supporting rods for limiting the rocking of said rods away from said angle members.

U.S. Pat. No. 3,076,522

Inventor: Harvey L. Goodell

Issued: Feb. 5, 1963

The invention discloses a scaffold apparatus for use on an elevated roadway comprising an elongated upstanding mobile frame adapted to straddle and rest upon an elevated roadway, a vertically disposed support member mounted on one end of said mobile frame and having a portion extending below said mobile frame, the lower end of said mobile frame extending vertically beneath the roadway, and a horizontally disposed walkway mounted on said support member for swinging movement in clockwise and counterclockwise directions of said walkway about said support member as a vertical axis into and out of position below and in longitudinal alignment with said frame, said walkway, when said mobile frame straddles and rests upon an elevated roadway, being of a length to extend beneath said roadway and adapted to support workmen thereon for the purpose of treating the underside of said roadway.

U.S. Pat. No. 3,945,462

Inventor: James D. Griswold

Issued: Mar. 23, 1976

Hanger brackets for suspending working scaffold or platform floors from overhead supports. Paired legs adjustably and pivotally joined together in scissors arrangement have finger ends for engaging overhead beams or elements thereof as depending portions of the legs that extend beneath the center pivot are moved inwardly. A spreader bar having a plurality of position adjustment openings is engaged between the depending legs to lock the fingers and bracket in place. The lower leg ends also provide a plurality of adjustment openings so the spreader bar may be engaged at alternate elevations for accommodating various staging or joist type components and for facilitating the attachment of safety elements.

U.S. Pat. No. 4,276,959

Inventor: Ronald A. Barber

Issued: Jul. 7, 1981

In the preferred and illustrated embodiment, a scaffold is shown for attachment on the bottom side of an offshore drilling rig or platform. The scaffold is quickly installed and removed. It is fabricated with a set of upright hanger straps which, in turn, clamp to eye beams spanning the bottom side of the offshore structure. The hanger straps incorporate opposing hooks at the upper end. The central portion is comprised of an elongate strap or hanger, the length accommodating workmen. Each strap terminates at its lower end with a support to receive framing members such as horizontally deployed structural beams. The beams support deck planking arranged horizontally thereon and spaced from the bottom side of the offshore structure.

U.S. Pat. No. 4,811,530

Inventor: Jon V. Eyerly

Issued: Mar. 14, 1989

A portable platform is formed of a plurality of elongated floor support members interconnected longitudinally and spaced apart laterally, the support members having a plurality of longitudinally spaced cross members, the confronting cross members being secured in alignment by interengaging coupling members and the laterally spaced floor support members being secured against lateral displacement by a plurality of elongated locking members interengaging adjacent pairs of support members. A plurality of elongated floor members are supported on the foregoing assembly and are secured together releasably along their longitudinal edges. The perimeter of the assembly of floor members is secured against vertical displacement relative to the underlying support assembly by means of a plurality of perimeter floor hold-down members which are secured removably against vertical and longitudinal displacement by a plurality of perimeter floor hold-down support members removably connected to the outer ends of the support members and outwardly extending associated cross members.

U.S. Pat. No. 4,854,419

Inventor: Louis G. Lyras et al.

Issued: Aug. 8, 1989

A mobile containment platform method and system for sandblasting and the like in bridge reconditioning and painting that requires removal of paint from the support structure of the bridge. The containment platform provides a safe secure entrapment envelope for spent abrasive and removed paint residue.

U.S. Pat. No. 5,011,710

Inventor: John F. Harrison

Issued: Apr. 30, 1991

Surfaces of a structure are treated from a walkway within an enclosure suspended from the structure. The enclosure has a downwardly-converging cross section terminating in a vacuum conveyor for collecting and removing particles accumulating from the blasting process. The enclosure is preferably provided in modules. The vacuum conveyor removes the particulate material for transfer to conventional separating and re-cycling equipment. The enclosure and walkway are moveably suspended from transverse guideways secured to the structure.

U.S. Pat. No. 5,299,655

Inventor: Nicholas Margaritis

Issued: Apr. 5, 1994

An enclosed workplace support for temporary, immovable installation below and on each side of a bridge or other existing structure while performing work on bridge substructure. Double rows of upper and lower outriggers are installed to extend outwardly from each lateral side of the bridge and cables are attached to the outer ends of each row of outriggers. Additional cables are attached at opposite ends to bearings or other bridge substructure and extend parallel to the bridge centerline for an entire span. The cables support a high-strength flooring, preferably or rubber-coated chain link fencing. A nylon tarp is laid over the fencing below the bridge and extends around each side, attached to the outrigger cables, and is sealed to the bridge curbs. An exhaust blower maintains the interior of the enclosed workplace at subatmospheric pressure.

U.S. Pat. No. 5,678,654

Inventor: Katsuo Uzawa

Issued: Oct. 21, 1997

A hanging scaffold panel for use in a hanging scaffold has a rectangular frame with an elongate male portion projecting from one side and attached to the rectangular frame with a fixing pin. The rectangular frame has a female portion on a side opposing the male portion and adapted to receive a male portion from an adjoining panel. The elongate male portion has two semi-cylindrical sections that are threadably adjusted to engage the female portion. A fastening pin is used to lock the male portion in the female portion.

U.S. Pat. No. 5,730,248

Inventor: Lambros Apostolopoulos

Issued: Mar. 24, 1998

A bridge platform and method of erecting the same wherein a plurality of cables extend longitudinally of the bridge in spaced relation below the deck or roadway and steel support structure of the bridge, which cables are supported at opposite ends by the spaced-apart vertical piers of the bridge, and wherein a plurality of platform flooring panels or sections are supported on the cables, extend laterally of the bridge, are arranged side-by-side along the length of the bridge between the piers and are removably secured to the cables. The cables are attached to the bridge piers by compression clamp structures. The platform flooring sections comprise elongated rectangular corrugated decking panels and are arranged in end-to-end overlapping relation transversely of the bridge, side-to-side overlapping relation longitudinally along the bridge and with the corrugations extending transversely of the cables. The corrugations maximize the strength-to-weight ratio of the platform flooring and provide recesses or receptacles to contain debris and facilitate its collection and removal. Each of the platform flooring sections is releasably connected at spaced locations to the supporting cables on which it rests. This is provided by connector assemblies each comprising a first part which engages the upper surface of the flooring section and the cable and a second part which engages the upper surface of the flooring section, the two parts being removably connected together through a small opening in the flooring. As a result, individual flooring sections can be removed to provide access through the flooring in emergency or critical situations while at the same time allowing the remainder of the flooring to retain collected debris.

U.S. Pat. No. 5,911,288

Inventor: Gregory Zafirakis

Issued: Jun. 15, 1999

A work platform for temporary installation under a bridge span includes a plurality of longitudinal support cables supporting transversely extending grating planks, with sidewise adjacent planks being interlocked by lock pins. A selected subset of the grating planks are releasably fastened to underlying support cables T-shaped clamping members inserted through slots in the selected grating planks.

U.S. Pat. No. 5,921,346

Inventor: Lambros Apostolopoulos

Issued: Jul. 13, 1999

A bridge platform and method of erecting the same wherein a plurality of cables extend longitudinally of the bridge in spaced relation below the deck or roadway and steel support structure of the bridge, which cables are supported at opposite ends by the spaced-apart vertical piers of the bridge, and wherein a plurality of platform flooring panels or sections are supported on the cables, extend laterally of the bridge, are arranged side-by-side along the length of the bridge between the piers and are removably secured to the cables. The cables are attached to the bridge piers by compression clamp structures. The platform flooring sections comprise elongated rectangular corrugated decking panels and are arranged in end-to-end overlapping relation transversely of the bridge, side-to-side overlapping relation longitudinally along the bridge and with the corrugations extending transversely of the cables. The corrugations maximize the strength-to-weight ratio of the platform flooring and provide recesses or receptacles to contain debris and facilitate its collection and removal. Each of the platform flooring sections is releasably connected at spaced locations to the supporting cables on which it rests. This is provided by connector assemblies each comprising a first part which engages the upper surface of the flooring section and the cable and a second part which engages the upper surface of the flooring section, the two parts being removably connected together through a small opening in the flooring. As a result, individual flooring sections can be removed to provide access through the flooring in emergency or critical situations while at the same time allowing the remainder of the flooring to retain collected debris.

U.S. Pat. No. 6,003,634

Inventor: Lambros Apostolopoulos

Issued: Dec. 21, 1999

A bridge platform and method of erecting the same wherein a plurality of cables extend longitudinally of the bridge in spaced relation below the deck or roadway and steel support structure of the bridge, which cables are supported at opposite ends by the spaced-apart vertical piers of the bridge, and wherein a plurality of platform flooring panels or sections are supported on the cables, extend laterally of the bridge, are arranged side-by-side along the length of the bridge between the piers and are removably secured to the cables. The cables are attached to the bridge piers by compression clamp structures. The platform flooring sections comprise elongated rectangular corrugated decking panels and are arranged in end-to-end overlapping relation transversely of the bridge, side-to-side overlapping relation longitudinally along the bridge and with the corrugations extending transversely of the cables. The corrugations maximize the strength-to-weight ratio of the platform flooring and provide recesses or receptacles to contain debris and facilitate its collection and removal. Each of the platform flooring sections is releasably connected at spaced locations to the supporting cables on which it rests. This is provided by connector assemblies each comprising a first part which engages the upper surface of the flooring section and the cable and a second part which engages the upper surface of the flooring section, the two parts being removably connected together through a small opening in the flooring. As a result, individual flooring sections can be removed to provide access through the flooring in emergency or critical situations while at the same time allowing the remainder of the flooring to retain collected debris.

U.S. Pat. No. 6,135,240

Inventor: Lambros Apostolopoulos

Issued: Oct. 24, 2000

A bridge platform and method of erecting the same wherein a plurality of cables extend longitudinally of the bridge in spaced relation below the deck or roadway and steel support structure of the bridge, which cables are supported at opposite ends by the spaced-apart vertical piers of the bridge, and wherein a plurality of platform flooring panels or sections are supported on the cables, extend laterally of the bridge, are arranged side-by-side along the length of the bridge between the piers and are removably secured to the cables. The cables are attached to the bridge piers by compression clamp structures. The platform flooring sections comprise elongated rectangular corrugated decking panels and are arranged in end-to-end overlapping relation transversely of the bridge, side-to-side overlapping relation longitudinally along the bridge and with the corrugations extending transversely of the cables. The corrugations maximize the strength-to-weight ratio of the platform flooring and provide recesses or receptacles to contain debris and facilitate its collection and removal. Each of the platform flooring sections is releasably connected at spaced locations to the supporting cables on which it rests. This is provided by connector assemblies each comprising a first part which engages the upper surface of the flooring section and the cable and a second part which engages the upper surface of the flooring section, the two parts being removably connected together through a small opening in the flooring. As a result, individual flooring sections can be removed to provide access through the flooring in emergency or critical situations while at the same time allowing the remainder of the flooring to retain collected debris.

U.S. Pat. No. 6,138,793

Inventor: Lambros Apostolopoulos

Issued: May 8, 2001

A work platform for use on bridges wherein a plurality of cables extend along a section of the bridge in spaced relation below the deck or roadway and steel support structure of the bridge, which cables are supported at opposite ends by either the steel support structure of the bridge or by the spaced-apart vertical piers of the bridge, and wherein a plurality of platform flooring panels or sections are supported on the cables, extend laterally of the cables, are arranged side-by-side along the section of the bridge such as between the piers and are removably secured to the cables. In one aspect the cables are connected at each end exclusively to the bridge piers, and in another aspect the cables are connected at each end exclusively to the bridge steel structure. In the latter instance, there is provided the capability of installation on skewed or angled bridge sections. In both aspects there is capability of adjustment in vertical and horizontal directions. The platform flooring sections comprise elongated rectangular corrugated decking panels and are arranged in end-to-end overlapping relation transversely of the cables, side-to-side overlapping relation along the bridge and with the corrugations extending transversely of the cables. The corrugations maximize the strength-to-weight ratio of the platform flooring and provide recesses or receptacles to contain debris and facilitate its collection and removal. Each of the platform flooring sections is releasably connected at spaced locations to the supporting cables on which it rests. This is provided by connector assemblies comprising a first part which engages the upper surface of the flooring section and the cable and a second part which engages the upper surface of the flooring section, the two parts being removably connected together through a small opening in the flooring. As a result, individual flooring sections can be removed to provide access through the flooring in emergency or critical situations while at the same time allowing the remainder of the flooring to retain collected debris. A connector assembly also is provided which has a manually operated lever for selectively placing the connector assembly in clamped or unclamped positions relative to the cable and flooring section. The corrugated decking panels can be provided with hinged plates for covering the corrugations to provide a substantially flat surface over the panels.

U.S. Pat. No. 6,227,331

Inventor: Lambros Apostolopoulos

Issued: May 8, 2001

A bridge platform and method of erecting the same wherein a plurality of cables extend longitudinally of the bridge in spaced relation below the deck or roadway and steel support structure of the bridge, which cables are supported at opposite ends by the spaced-apart vertical piers of the bridge, and wherein a plurality of platform flooring panels or sections are supported on the cables, extend laterally of the bridge, are arranged side-by-side along the length of the bridge between the piers and are removably secured to the cables. The cables are attached to the bridge piers by compression clamp structures. The platform flooring sections comprise elongated rectangular corrugated decking panels and are arranged in end-to-end overlapping relation transversely of the bridge, side-to-side overlapping relation longitudinally along the bridge and with the corrugations extending transversely of the cables. The corrugations maximize the strength-to-weight ratio of the platform flooring and provide recesses or receptacles to contain debris and facilitate its collection and removal. Each of the platform flooring sections is releasably connected at spaced locations to the supporting cables on which it rests. This is provided by connector assemblies each comprising a first part which engages the upper surface of the flooring section and the cable and a second part which engages the upper surface of the flooring section, the two parts being removably connected together through a small opening in the flooring. As a result, individual flooring sections can be removed to provide access through the flooring in emergency or critical situations while at the same time allowing the remainder of the flooring to retain collected debris.

U.S. Pat. No. 6,264,002

Inventor: Lambros Apostolopoulos

Issued: Jul. 24, 2001

A work platform for use on bridges or other structures wherein a plurality of cables extend in spaced relation along a section of the structure and are supported by the structure and wherein a floor comprising a plurality of corrugated flooring panels or sections is supported on the cables and removably secured to the cables. The positions of the cables are adjustable in vertical and horizontal directions. A connector assembly releasably connects each of the platform flooring sections to a respective supporting cable on which it rests. Each connector assembly comprises a first part which rests on a bottom wall of the panel and has a portion which extends through an opening in the bottom wall and back through the opening and is connected to a second part to form an eyelet through which the cable passes. In aspects of the present invention, the first and second parts are connected by a lever or a wedge. The corrugated decking panels have hinged plates for covering the corrugations to provide a substantially flat surface over the panels while allowing nestability for storage and transport. In one aspect of the invention, a pair of floors are connected by a gutter and are inclined therefrom, and the cable positions are adjustable to vary the angle of inclination as well as to vary the height and spacing of the cables. The inclined floors are vibrated to effect removal of debris to the gutter where it may be more easily removed.

While these suspended work platforms may be suitable for the purposes for which they were designed, they would not be as suitable for the purposes of the present invention, as hereinafter described.

SUMMARY OF THE PRESENT INVENTION

A primary object of the present invention is to provide one or more containment suspended work platforms beneath an aerial roadway whereby maintenance can be performed.

Another object of the present invention is to provide one or more containment suspended work platforms having a plurality of horizontal cables forming platform support members spaced parallel to the aerial roadway and fastened to the roadway abutments.

Yet another object of the present invention is to provide one or more containment suspended work platforms having platform support cables fastened between cable slings fastened around the rocker bearing plates positioned between roadway abutments and roadway girders.

Still yet another object of the present invention is to provide one or more cable attachment anchor plates removably fastened to the roadway abutments.

Another object of the present invention is to provide one or more containment suspended work platforms having platform support cables fastened between said temporary abutment anchors.

Yet another object of the present invention is to provide one or more containment suspended work platforms having a plurality of horizontal cables forming platform support members spaced parallel to the aerial roadway and fastened to cable slings extending between abutment rocker bearings.

Still yet another object of the present invention is to provide a sheath for the cable slings at the corners of engagement with the abutment rocker plate.

Another object of the present invention is to provide one or more containment suspended work platforms using corrugated steel as the flooring for said platform.

Yet another object of the present invention is to provide one or more containment suspended work platforms wherein the corrugations of the steel can be used for the accumulation of maintenance debris.

Still yet another object of the present invention is to provide one or more containment suspended work platforms wherein the corrugations of the steel can be used as channels for the containment of steel cables.

Another object of the present invention is to provide one or more containment suspended work platforms wherein the corrugations of the steel can be used as recesses for the placement therein of J-bolts for fixedly positioning the corrugated steel to the cable support members.

Yet another object of the present invention is to provide one or more containment suspended work platforms wherein the corrugated steel sheet forms a rigid member for the attachment thereto of the flexible wall retention members.

Still yet another object of the present invention is to provide one or more containment suspended work platforms wherein the corrugated steel platform has one or more support members extending from the platform support cables to the opposing flanges of an aerial roadway support girder.

Another object of the present invention is to provide one or more containment suspended work platforms wherein the corrugated steel platform has one or more support members extending from the platform support cables to the exterior flanges of opposing aerial roadway support girders.

Yet another object of the present invention is to provide one or more containment suspended work platforms wherein the corrugated steel platform has one or more support members extending from the platform support cables forming a loop from said cable having a diaphragm girder passing therethrough.

Still yet another object of the present invention is to provide one or more containment suspended work platforms wherein the horizontal platform cable has one or more support members extending from the said cable to a hanger extending from the roadway parapet.

Another object of the present invention is to provide one or more containment suspended work platforms wherein the horizontal platform cable has a support member extending from the said cable to a hanger extending from the intersection of girder cross bracing.

Yet another object of the present invention is to provide one or more containment suspended work platforms wherein the horizontal platform cable has a support member extending from said cable to a hanger extending from the I-beam cross braces.

Still yet another object of the present invention is to provide one or more containment suspended work platforms wherein the steel sheets are covered by substantially similar material as the flexible walls and fastened thereto whereby cleanup of abrasive material is easier.

Additional objects of the present invention will appear as the description proceeds.

The present invention overcomes the shortcomings of the prior art by providing a support system for a work platform comprised of cables extending from roadway bearing members having a protective sheath where said cables engage said roadway bearing members. Further having cables fastened to the midpoint of cables secured between girder bearing members. Additionally having cables fastened to anchor plates temporarily bolted to roadway abutment members during the life of the suspended work platform.

The cables form a support network for the placement thereon of decking. In the preferred embodiment the decking material is corrugated steel plates having a thickness conforming to the live and dead load placed thereon by the men, equipment and maintenance debris. The decking is secured to the horizontal support cables by a plurality of J-bolts and in addition by inserting fasteners in overlapping plates.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

LIST OF REFERENCE NUMERALS UTILIZED IN THE DRAWINGS

10 suspended work platform
12 suspension roadway
13 suspended roadway guiderails
14 I-beams
16 suspension girder bays
18 steel plates
20 horizontal cables
21 cable slings
22 vertical cables
24 j-bolt
26 flexible wall
28 flexible wall retainer
30 flexible wall retainer fastener
32 partition frame
34 partition
36 ducts
38 abutments plates
40 bearings
42 bearing cables
44 diaphragm girders
46 hook-like fasteners
48 abutment
50 abutment plate anchors
52 horizontal cable shackle
54 cable fasteners
56 downrigger support cable
58 downrigger horizontal cable support
60 downrigger

BRIEF DESCRIPTION OF THE DRAWING FIGURES

In order that the invention may be more fully understood, it will now be described by way of example, with reference to the accompanying drawing in which.

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
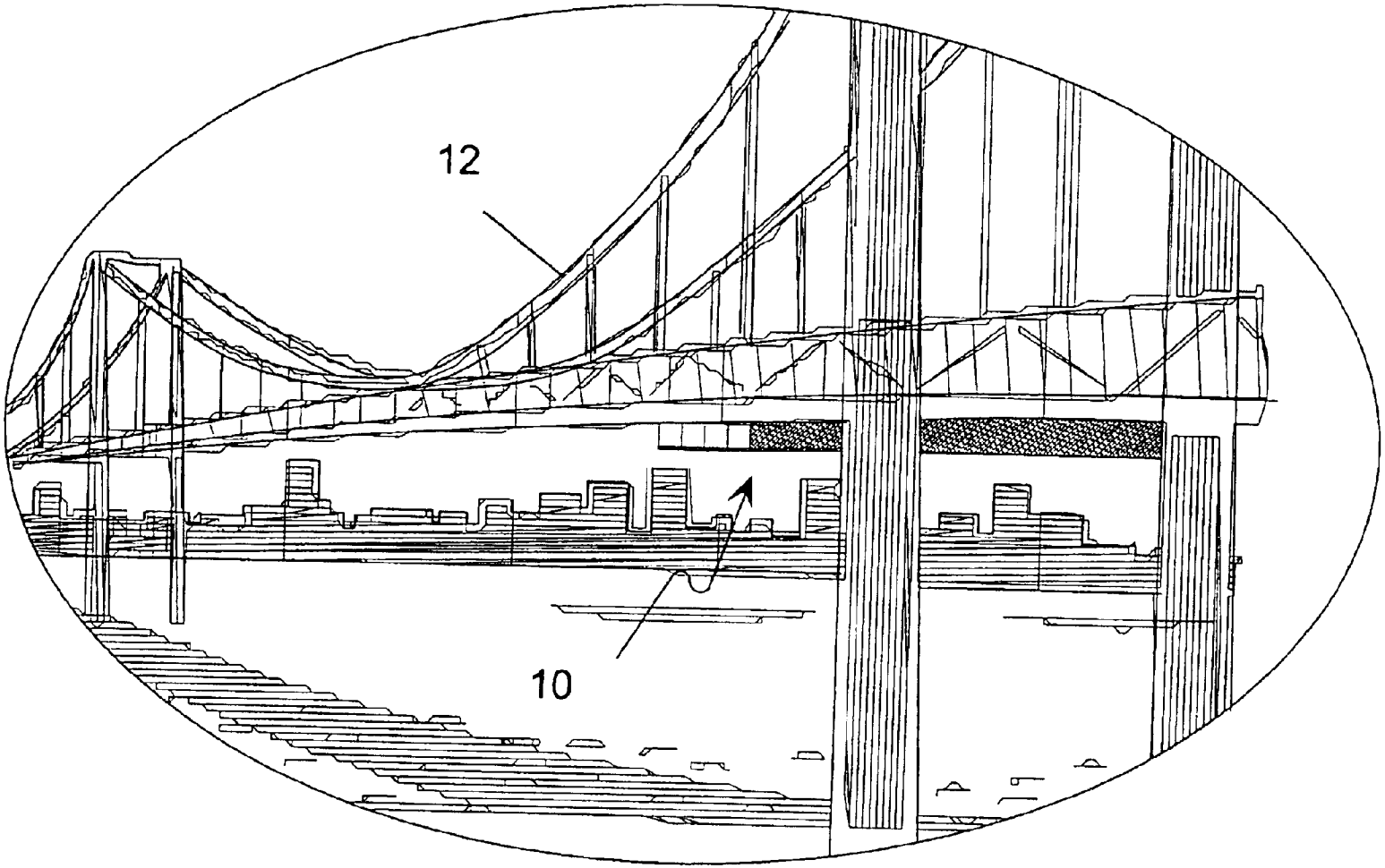
FIG. 1 is an illustrated view of the present invention in use.

Referring to FIG. 1, shown is a bridge 12 having a suspended platform 10 installed therefrom. The suspended platform provides a containment area below a suspended roadway whereby maintenance of the support structure can be perform. The suspended work platform is an enclosure where the debris from maintenance is contained therein.

Figure 2:
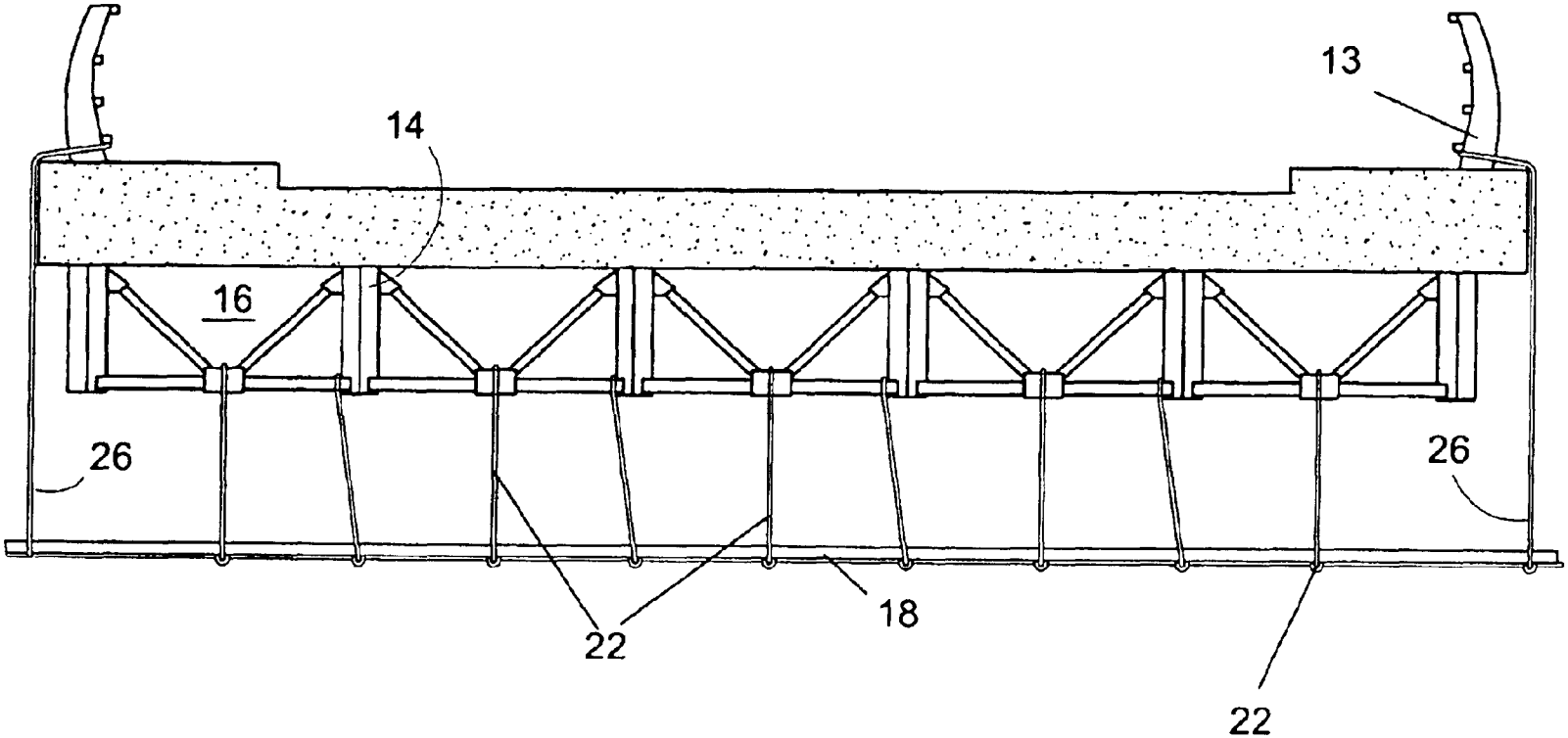
FIG. 2 is sectional view of the present invention installed on a beam bridge.

Referring to FIG. 2, shown is a sectional view of the work platform suspended from one type of elevated roadway, a beam bridge 12. The mid-bay hangers 22 are supported from the middle of each cross-brace and the platform support cables 20 are rigged between abutments and the outer platform support cables are secured to abutment plates 38 anchored into the concrete abutments. Shown is a corrugated platform 18 suspended below a suspension bridge 12 and a containment enclosure in the form of a tarp 26 being installed therearound to conform with D.O.T. specifications. The present invention is a rigging system and method for suspending a platform from a bridge structure 12 to allow workers to access the bottom portion thereof for maintenance purposes such as sandblasting, painting, structural inspections and the like. The present invention utilizes a combination of substantially vertical hanging cables 22 or chains suspended from beams 14 and girders to support substantially horizontal cables or chains 20 fastened to girder or abutment bearings. Overlapping sections of corrugated panels 18 are placed end to end and side to side on the horizontal cables 20 with the corrugations extending perpendicular in relation to the cables. Abutment plates 38 are anchored into the abutments to support the outer cable attachments 22. The rigging system and method of the present invention is designed primarily for beam bridges but may also be used with suspension bridges or any other bridge or structure with which the application would be appropriate.

Figure 3:
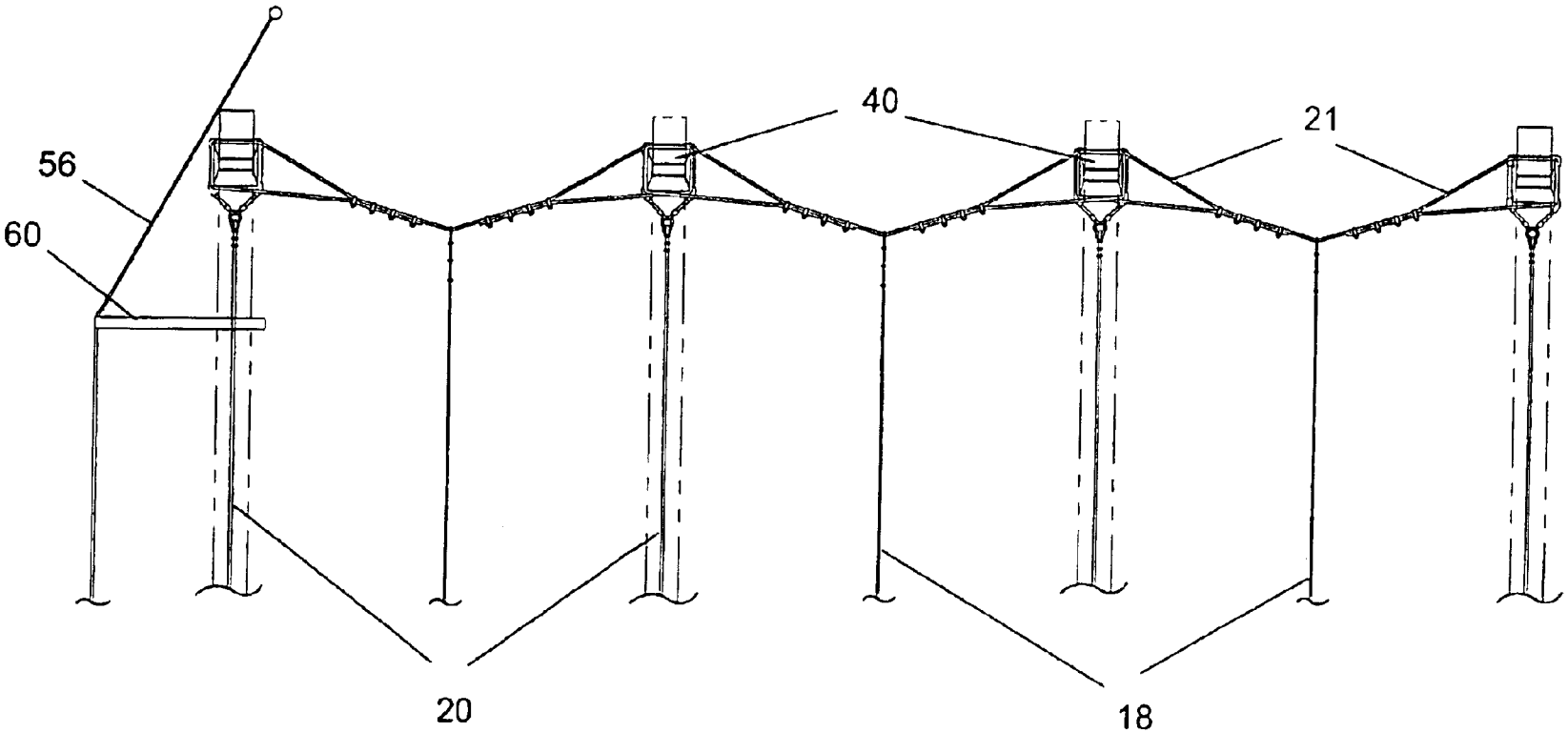
FIG. 3 is a top view of the horizontal platform support cable attachment.

Referring to FIG. 3, shown is the platform 10 horizontal support cable 18 extending from cable slings 21. Cable sling 21 is fastened to adjacent bearing plates 40. Downriggers 60 are used to support the exterior cable 56 and are slidably locked onto the lower flange of the fascia girder.

Figure 4:
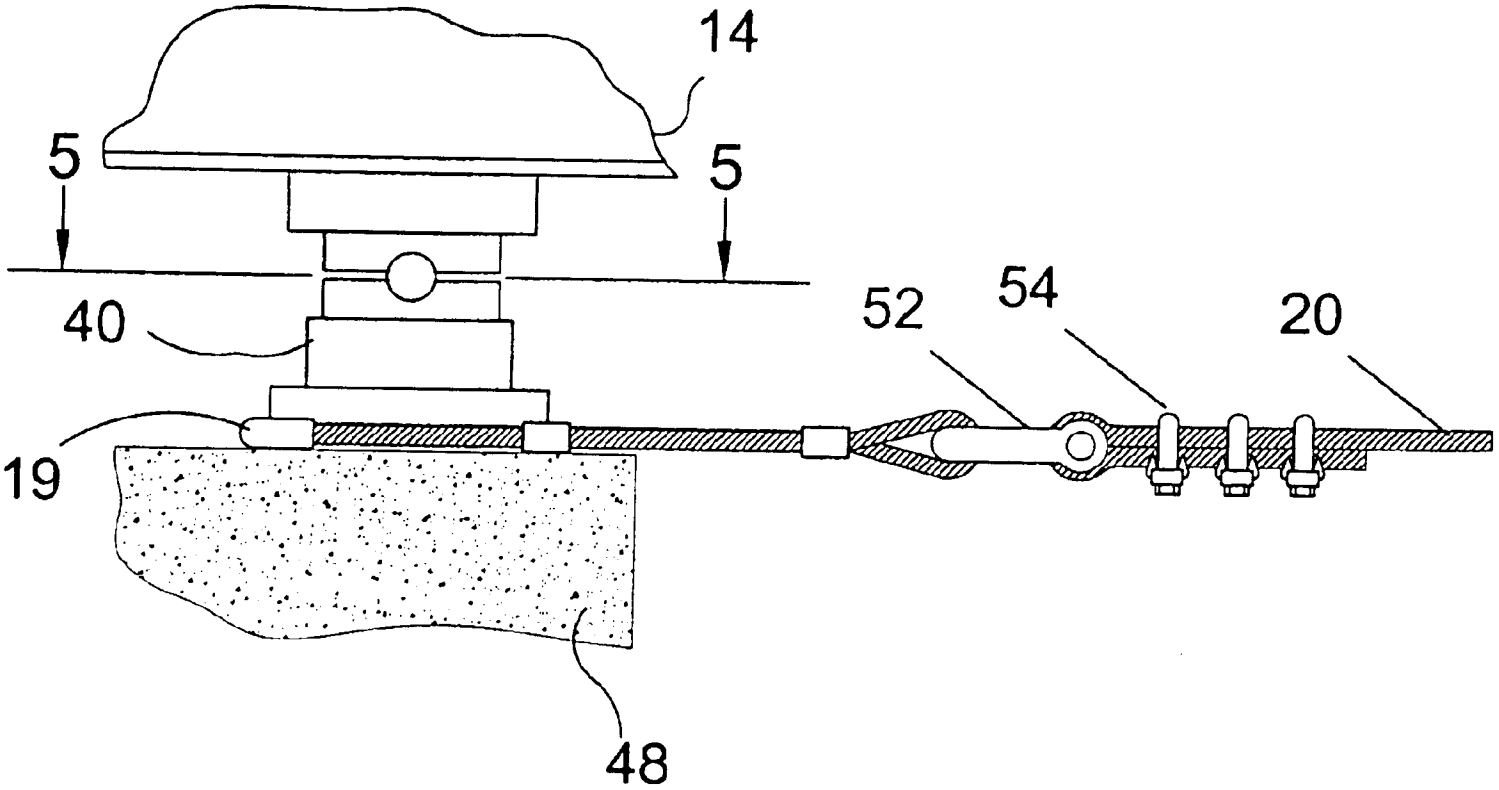
FIG. 4 is a sectional side view of a horizontal platform support cable and girder bearing.

Referring to FIG. 4, shown is a sectional side view of a horizontal platform support cable 20 having cable fasteners 54 and shackle 52 fastened to girder bearing 40. The platform support cables 18 beneath the girders are fastened horizontally around the bearing masonry plates 40 using cable slings 21.

Figure 5:
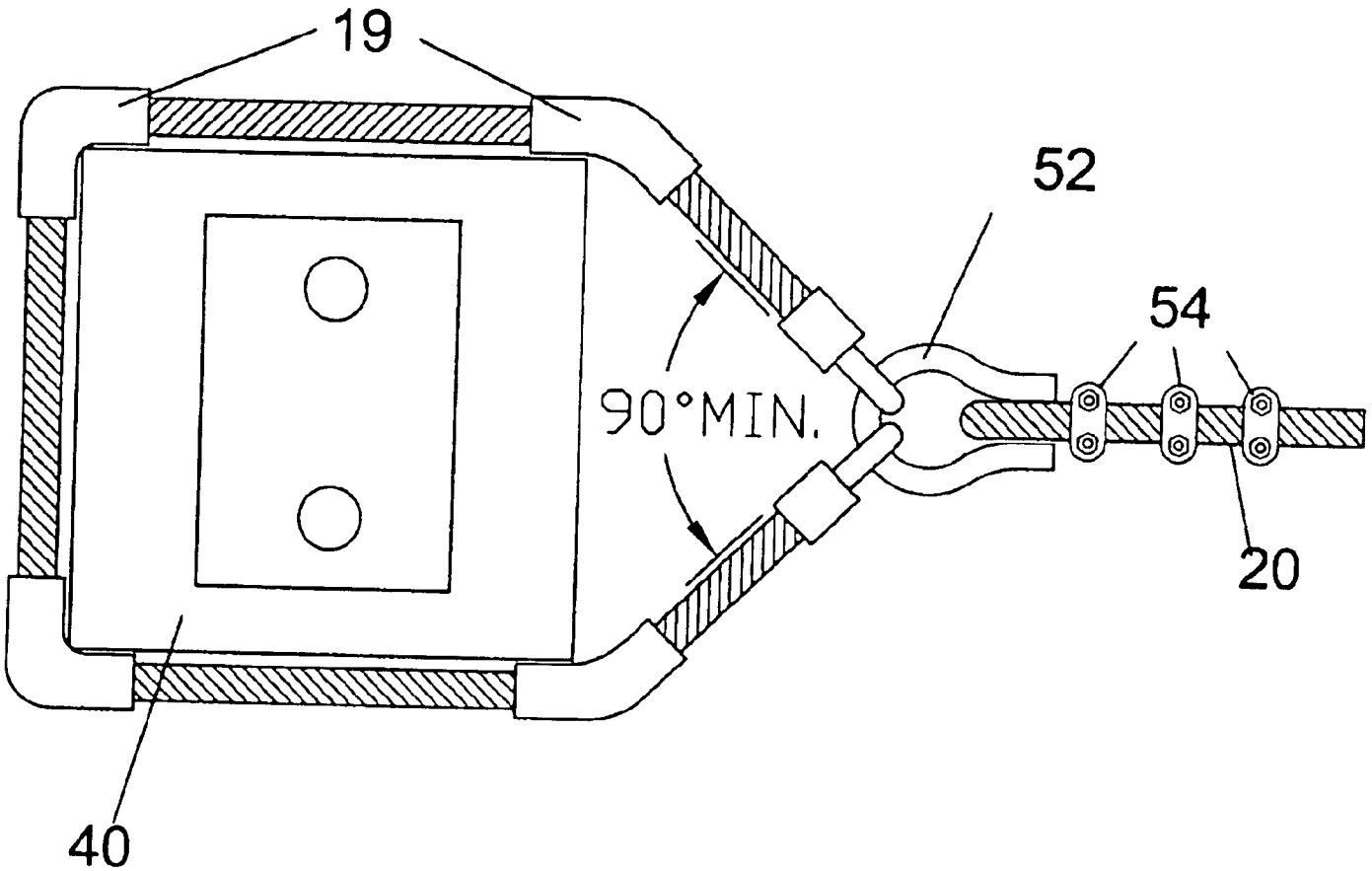
FIG. 5 is a plan view of a platform support cable fastened to an abutment beam.

Referring to FIG. 5, shown is a plan view of a platform 10 support cable 20 fastened to a bearing beam 40. The platform support cable 20 is looped into a cable sling and secured around the bearing masonry plate 40 located on a pier or an abutment. Sections of heavy-duty blast hose 19 encompass the cable at the corners of the masonry plate 40 to maintain the integrity thereof. Three cable clips 54 secure a turnback that is no less than 12 inches long. The cable, shackle 52 and cable clips 54 form the choker assembly with the preferable diameter of the cable being ⅝" with the accessories sized accordingly. If the internal angle of the of the choker assembly exceeds ⅝" the cable diameter should be increased to ¾".

Figure 6:
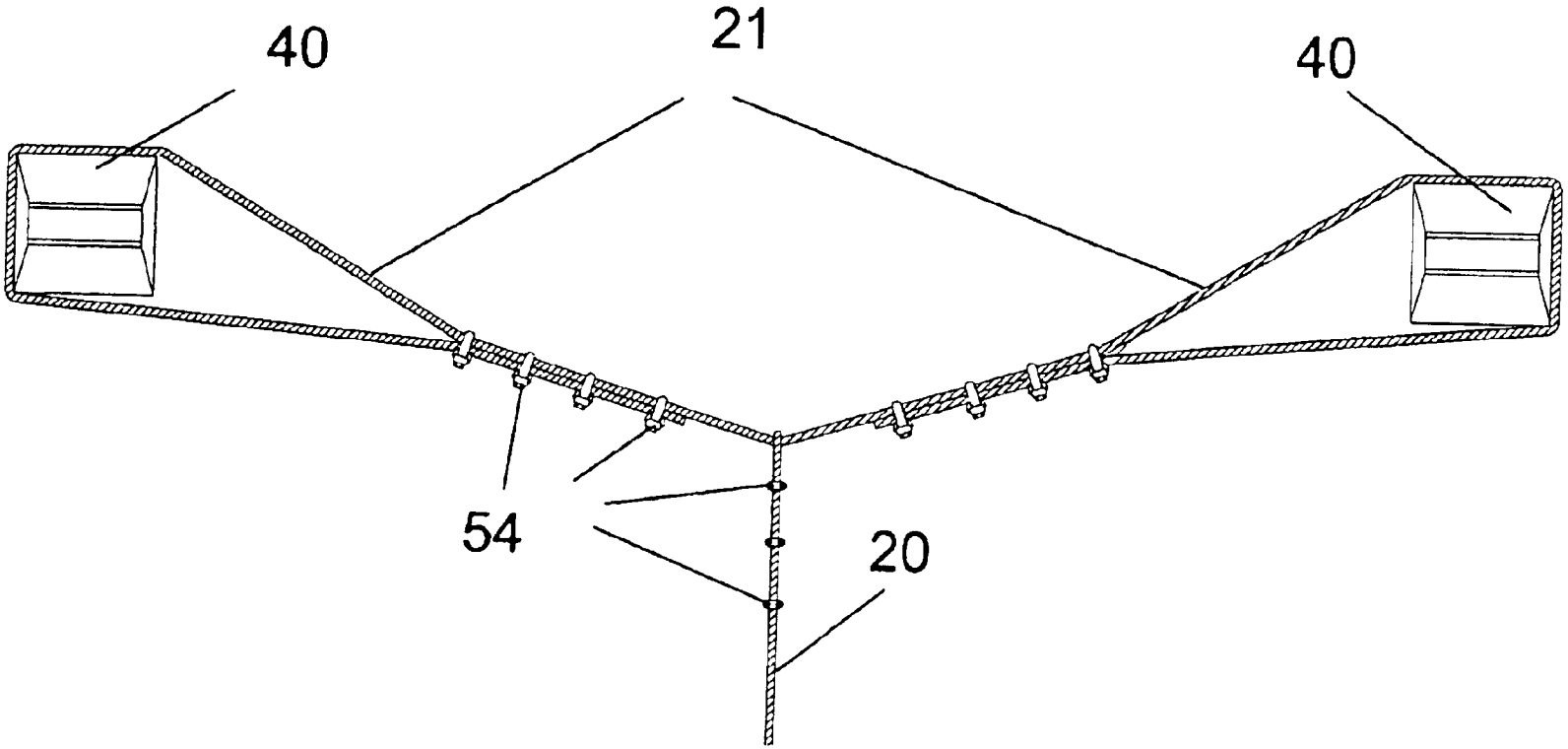
FIG. 6 is a detail view of a mid-bay cable attachment.

Referring to FIG. 6, shown is a detail view of a mid-bay cable attachment. The mid-bay cable 21 attachments are rigged between girder bearings 40 at the abutments. Four cable clips 54 are preferred on the dead ends of the substantially horizontal cables and a minimum of three cable clips 54 are preferred on the vertical interior cable.

Figure 7:
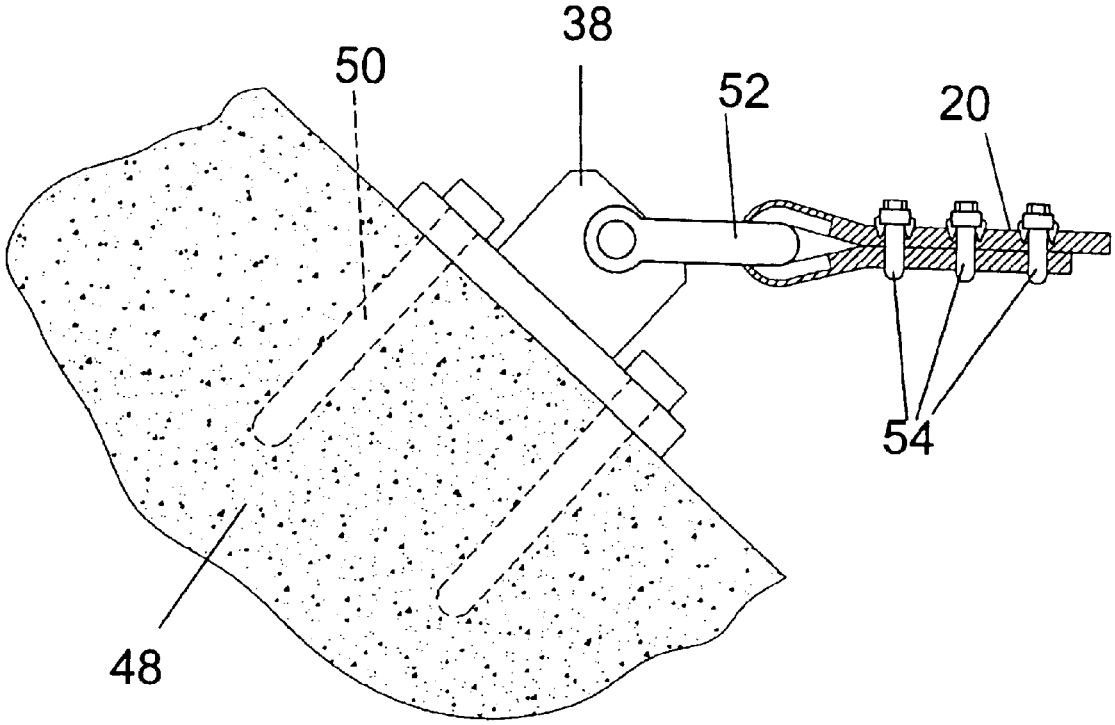
FIG. 7 is a sectional view of the abutment plate installed.

Referring to FIG. 7, shown is a sectional view of the abutment plate 38 installed. The outer platform support cables 20 are secured to abutment plates 38 that are anchored into the concrete abutments 48 with hilti bolts 50.

Figure 8:
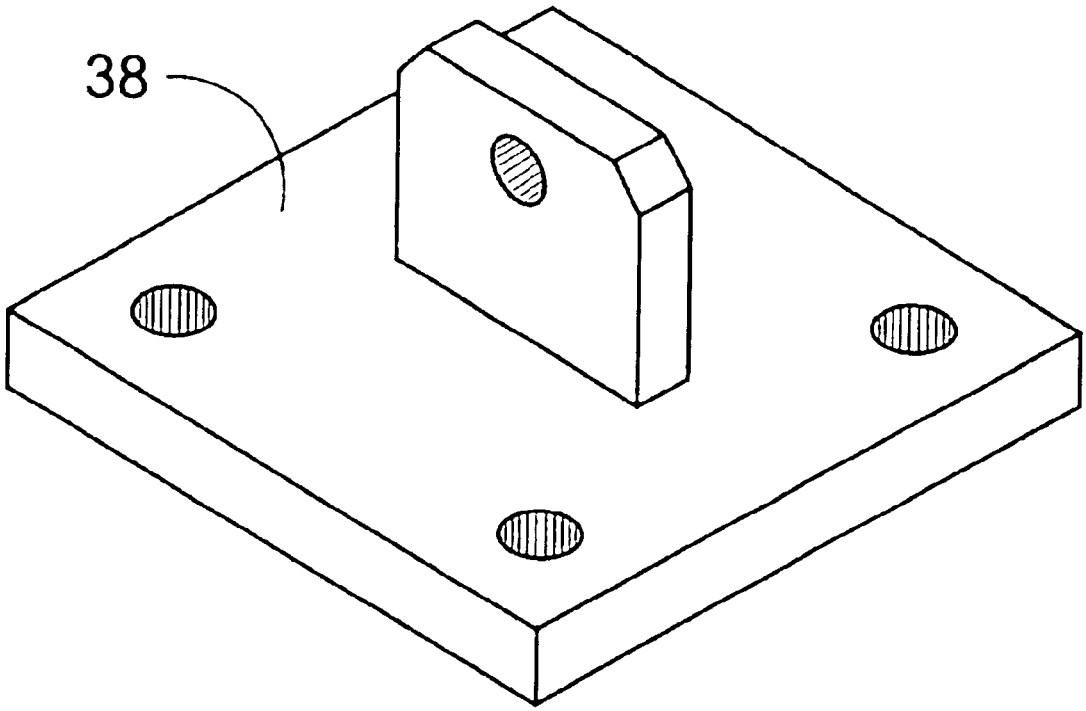
FIG. 8 is a perspective view of an abutment plate.

Referring to FIG. 8, shown is a perspective view of an abutment plate 38 which is used to attach horizontal cable 18 to the bridge abutment 48.

Figure 9:
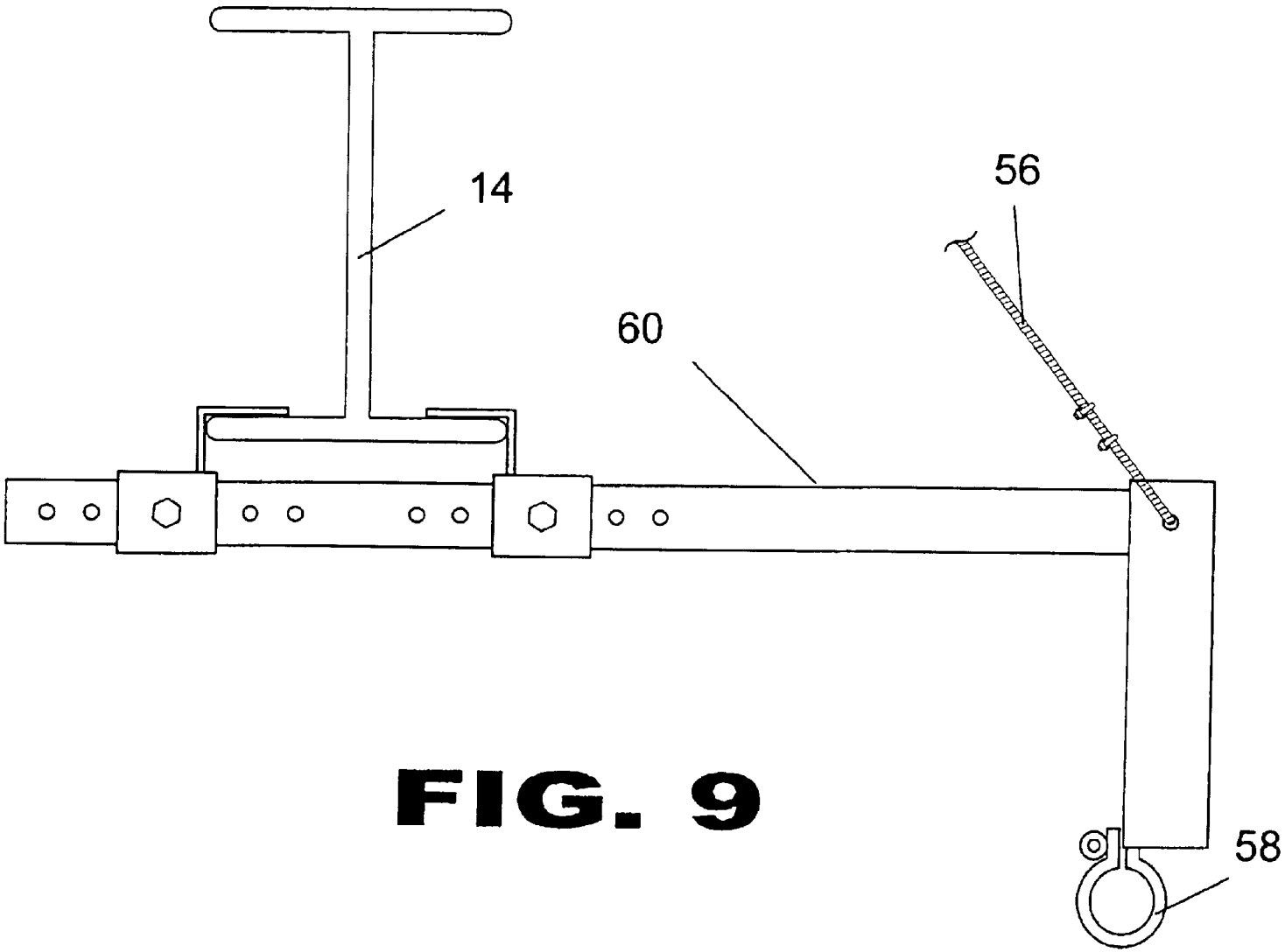
FIG. 9 is a side view of a downrigger.

Referring to FIG. 9, shown is a side view of a downrigger 60. The downriggers 60 are used to support the exterior horizontal cable 20 in a parallel position away from the structure. The buttress cable 56 is connected on one end to the distal end of the downrigger 60 and the other end is fastened to the bridge guide rails 13.

Figure 10:
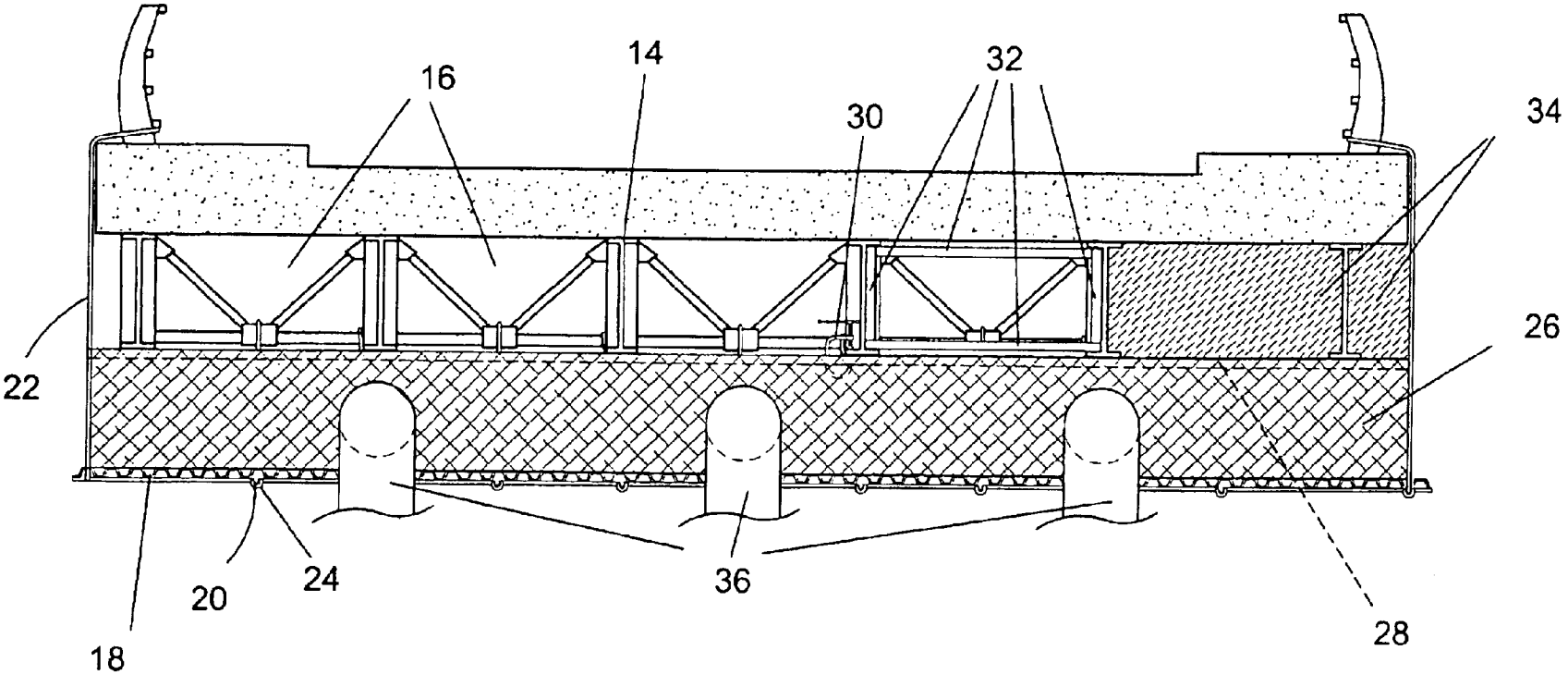
FIG. 10 is a sectional view of the containment area.

Referring to FIG. 10, shown is a sectional view of the containment area 10. The sides of the platform 10 are completely sealed by tarps 26 and one end has three evenly spaced exhaust ducts 36 leading to a mobile dust collector and the end opposite the exhaust ducts has air inlet openings installed in the plywood 34 within the girder bays. A divider wall will be installed to divide the containment area in two separate zones in the event that two mobile dust collectors are used with each zone having three evenly spaced exhaust ducts leading to one collector.

Figure 11:
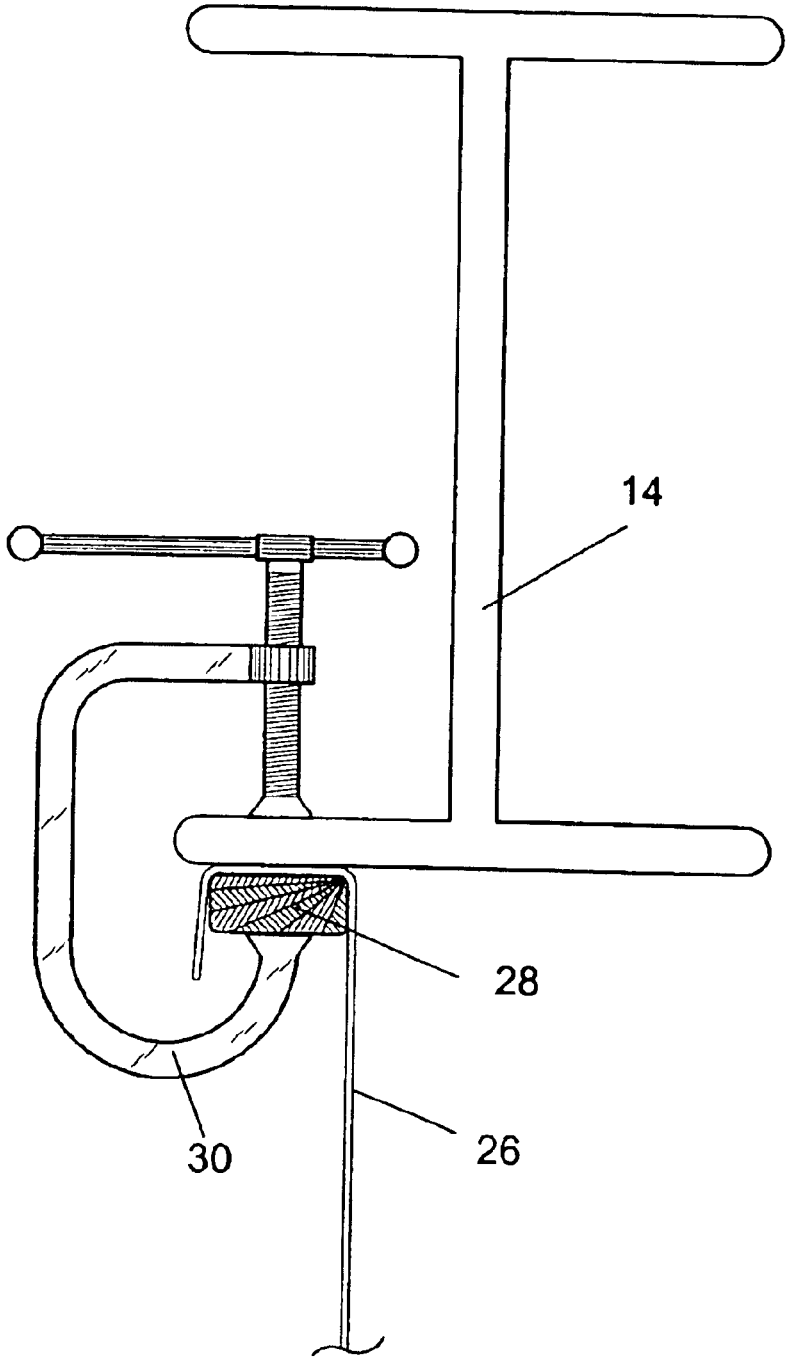
FIG. 11 is a side view girder attachment of the divider wall.

Referring to FIG. 11, shown is a side view girder attachment 14 of the divider wall. A divider wall when more than one mobile dust collector is used. The upper edge of the tarp 26 is sandwiched between the girder 14 and a firring strip 28 and secured therein by a c-clamp 30.

Figure 12:
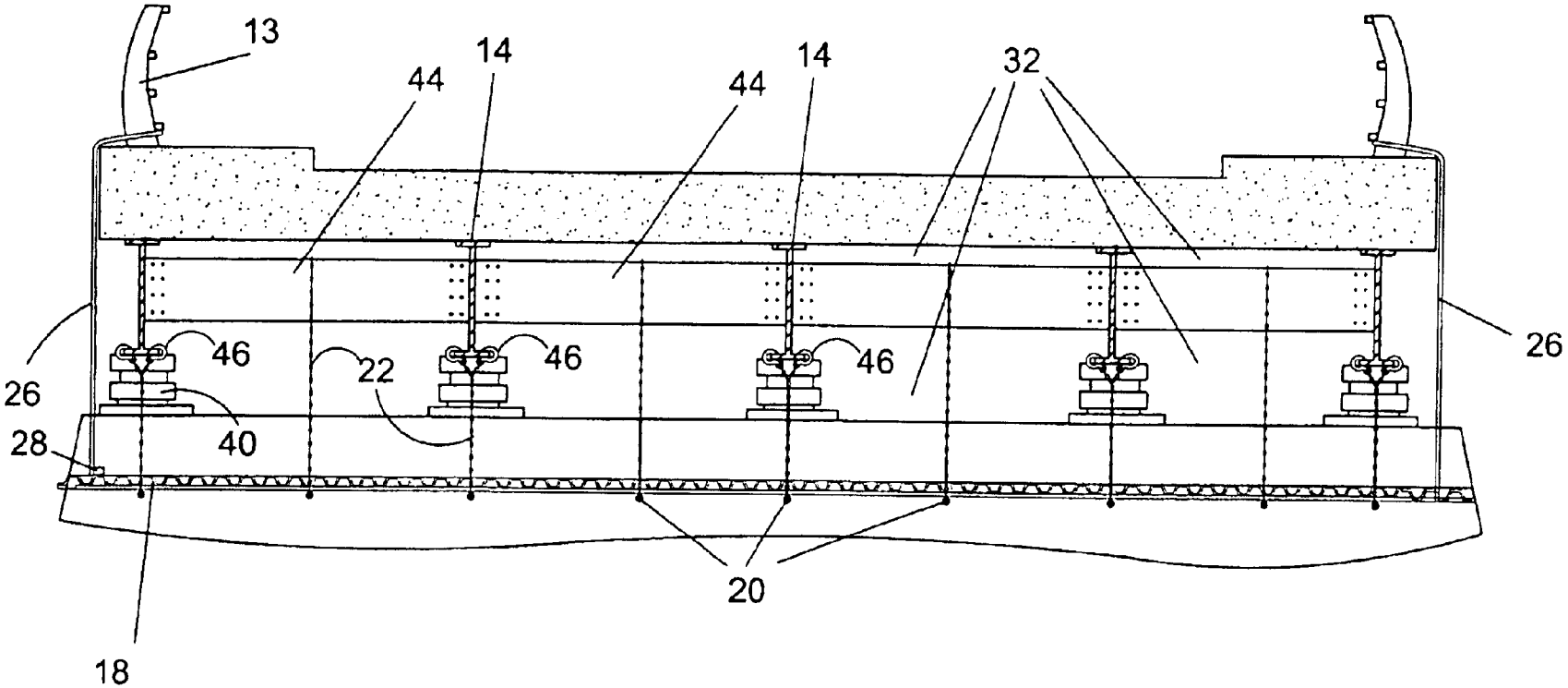
FIG. 12 is a side view of the suspended platform having perpendicular cable attached to I-beams.

Referring to FIG. 12, shown is the suspended platform 10 having steel plates 18 supported by a plurality of horizontal cables 20 having vertical cables/chains 22 having hook-like fasteners 46 attached to I-beams 14 and diaphragm beams 44. The I-beams 14 reside on the bearings 40 having diaphragm beams positioned therebetween. Partition frame 32 which can be comprised of the flexible material 26 forming the exterior walls of the work enclosure 10 or constructed of wood frame material covered by plywood whereby the enclosure can be subdivided into more than one enclosed workspace. The flexible wall 26 can be attached to the roadway guardrails 13 at the top end and fastened the platform 18 by means of flexible wall retainer 28.

What is claimed is new and desired to be protected by Letters Patent is set forth in the appended claims:

1. A temporary hermetic structure in combination with a bridge comprising:

a suspended floor made up of overlapping sections of corrugated panels;

walls of pliable sheet material combined with an undersurface of said bridge and bridge abutments forming an enclosure defining a workspace wherein persons having access to bridge substructure can work to repair and maintain said substructure while containing debris derived from said work;

a plurality of vertical hanging cables extending down from said bridge attached at lower ends to a plurality of horizontally extending cables supporting said floor of corrugated panels, ends of said horizontally extending cables being attached to bearing members on said bridge;

top edges of said walls of pliable sheet material being secured with the use of C-clamps to girders;

exhaust ducts mounted through said walls of pliable sheet material to carry away dust accumulating in work areas.

2. The structure of claim 1 wherein a cable engaging a bearing member is encased in a sheath to protect the cable from the maintenance work being performed on the bearing member.

3. The structure of claim 1 wherein a horizontal cable terminates in a V wherein the distal ends of the V have hook-shaped members engaging opposing flanges of opposing I-beams of said bridge and a vertex of said V has a hook-shaped member with a latch engaging the horizontal cable.

4. The structure of claim 1 wherein a vertical cable has a hook-shaped member with a latch engaging a horizontal cable and a length of the vertical cable is looped around a diaphragm beam of substructure of said bridge.

5. The structure of claim 1 wherein the overlapping sections of corrugated panels have fasteners positioned to secure one corrugated panel to another.

6. The structure of claim 1 wherein the pliable sheet material covers the floor to aid in the removal of any sandblasting material.

7. The structure of claim 6 wherein the pliable sheet material is fastened to the corrugated panels by wrapping a hem of the pliable sheet material around lengths of wood and fastening the wood to decking material of said bridge.

* * * * *